US012262804B2

(12) United States Patent
Brada et al.

(10) Patent No.: US 12,262,804 B2
(45) Date of Patent: Apr. 1, 2025

(54) DEPILATING DEVICE

(71) Applicant: KONINKLIJKE PHILIPS N.V., Eindhoven (NL)

(72) Inventors: Ype Bernardus Brada, Leeuwarden (NL); Maurits Koenen, Eindhoven (NL); Bart-Jan Zwart, Groningen (NL); Joost Tomas Glazenburg, Groningen (NL); Geert Willem De Goeij, Drachten (NL); Hermanus Mathias Joannes Rene Soemers, Mierlo (NL); Franciscus Jozef Bosman, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 361 days.

(21) Appl. No.: 17/782,698

(22) PCT Filed: Dec. 28, 2020

(86) PCT No.: PCT/EP2020/087898
§ 371 (c)(1),
(2) Date: Jun. 6, 2022

(87) PCT Pub. No.: WO2021/130385
PCT Pub. Date: Jul. 1, 2021

(65) Prior Publication Data

US 2023/0014597 A1 Jan. 19, 2023

(30) Foreign Application Priority Data

Dec. 27, 2019 (EP) ..... 19219802

(51) Int. Cl.
*A45D 26/00* (2006.01)

(52) U.S. Cl.
CPC ..... *A45D 26/0052* (2013.01); *A45D 26/0023* (2013.01)

(58) Field of Classification Search
CPC ..... A45D 26/0023; A45D 26/0052; A45D 26/0047
See application file for complete search history.

(56) References Cited

U.S. PATENT DOCUMENTS 4,079,741 A 3/1978 Daar
5,133,722 A 7/1992 Avrahami
(Continued)

FOREIGN PATENT DOCUMENTS

DE 9116912 U1 7/1994
EP 2127552 A1 12/2009
(Continued)

OTHER PUBLICATIONS

International Search Report and Written Opinion Dated Mar. 15, 2021 For International Application No. PCT/EP2020/087898 Filed Dec. 28, 2020.
(Continued)

*Primary Examiner* — Katherine H Schwiker

(57) ABSTRACT

A depilating device (1) comprises a depilating body (10) which is rotatable about a rotation axis (R) extending in a longitudinal direction (L) with respect to the depilating body (10) and which is provided with at least one hair-catching space (11). The depilating device (1) further comprises an actuating mechanism (30) configured to act on the depilating body (10) so as to cause compression and extension of the depilating body (10) in the longitudinal direction (L) during rotational movement of the depilating body (10) about the rotation axis (R), for the purpose of varying the size of the hair-catching space (11) of the depilating body (10) in the longitudinal direction (L), wherein the actuating mechanism (30) includes a force-inducing member (31) which is com-
(Continued)

pressible and extensible in the longitudinal direction (L) and which has a function in determining the level of a hair-clamping force in the depilating body (10).

13 Claims, 1 Drawing Sheet

(56) References Cited

U.S. PATENT DOCUMENTS

| | | | |
|---|---|---|---|
| 2003/0014059 | A1 | 1/2003 | Caoduro |
| 2009/0240260 | A1 | 9/2009 | Yang |

FOREIGN PATENT DOCUMENTS

| | | | |
|---|---|---|---|
| GB | 577271 | A | 5/1946 |
| JP | 2001327322 | A | 11/2001 |
| WO | 9304607 | A1 | 3/1993 |
| WO | 94/14355 | A1 | 7/1994 |

OTHER PUBLICATIONS

International Preliminary Report On Patentability Dated Oct. 11, 2021 For International Application No. PCT/EP2020/087898 Filed Dec. 28, 2020.

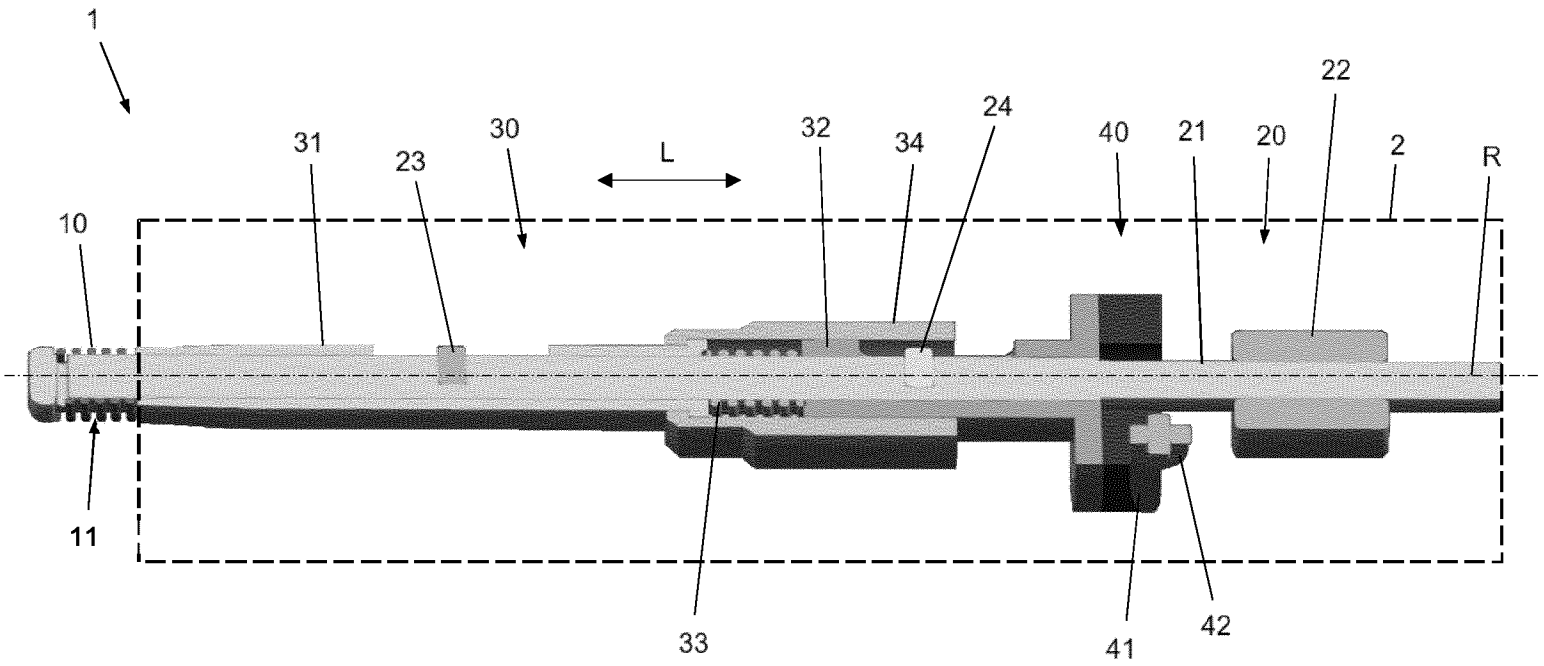
R
2
22
20
21
40
24
34
32
L
30
23
31
1
10
11
33
41
42

DEPILATING DEVICE

CROSS REFERENCE TO RELATED APPLICATIONS

This application is the U.S. National Phase application under 35 U.S.C. § 371 of International Application No. PCT/EP2020/087898 filed Dec. 28, 2020, which claims the benefit of European Patent Application Number 19219802.6 filed Dec. 27, 2019. These applications are hereby incorporated by reference herein.

FIELD OF THE INVENTION

The invention relates to a depilating device comprising a depilating body which is rotatable about a rotation axis extending in a longitudinal direction with respect to the depilating body and which is provided with at least one hair-catching space, wherein the size of the at least one hair-catching space in the longitudinal direction is variable through compression and extension of the depilating body in the longitudinal direction, and an actuating mechanism configured to act on the depilating body so as to cause compression and extension of the depilating body in the longitudinal direction during rotational movement of the depilating body about the rotation axis.

BACKGROUND OF THE INVENTION

U.S. Pat. No. 4,079,741 relates to an apparatus for skin-hair plucking, the apparatus comprising a portable housing, and a functional member having a plurality of closed helical windings, defining a substantially smooth external surface, installed in the housing so that the external surface is at least partly exposed for slidable engagement with the skin. Further, the apparatus is equipped with motor driven reciprocating means for alternately extending the functional member so that the windings thereof become spaced from each other and then re-closed one against the other, and motor driven means for rotating the functional member. In an embodiment, the functional member is constituted by a normally-closed coil spring, and the reciprocating means comprise a bar which extends within the spring and which is coupled to one end of the spring, wherein the other end of the spring is coupled to a sleeve which is rotatably mounted on the housing, and wherein rotatable cam means are provided in the housing for reciprocating the bar. The arrangement is such that as the spring-and-bar-assembly is driven, hairs clamped between adjacent windings during re-closing of the spring will be instantaneously plucked due to the rotation of the spring over the treated skin.

WO 94/14355 relates to a rotary hair plucker depilatory device comprising a hair plucker head which protrudes from a hand-held housing and is conformed by a cylindrical helicoidally coiled strip mounted on a rotary shaft and arranged to open and close a plurality of annular gaps during rotation to trap and pluck skin hair. In an embodiment, the rotary hair plucker depilatory device is conformed by three main functional groups, namely a miniature electric motor, the hair plucker head and a reciprocating mechanism body. The motor serves to provide motion to the reciprocating mechanism body and to the rotary shaft which rotates the hair plucker head at high speed. The reciprocating mechanism body produces a lineal alternate output motion which is applied to alternately stretch and compress the hair plucker head so that opening and closing of the plurality of annular gaps in the outer surface of the hair plucker head is obtained. In this way, it is achieved that during operation, skin hair is trapped in the gaps when opened and subsequently plucked as the gaps close and the hair plucker head rotates. In particular, the reciprocating body comprises cam means which are configured to convert rotation into the lineal alternate output motion synchronous with rotation of the hair plucker body.

U.S. Pat. No. 5,133,722 A discloses a method and device for plucking hair by engaging the hair with a hair-plucker body to clamp the hair thereto, moving the hair-plucker body and the hair clamp thereto in the plucking direction with respect to the skin, and successively interrupting the movement of the hair-plucker body and the hair clamp thereto such that the hair-plucker body applies a series of short tugs to the hair until it is plucked from the skin.

EP 2 127 552 A1 discloses an epilation element 10 having a skin side intended for contacting the skin in an operation state of the epilation device. The actuation arrangement of claim 1 actuates the epilating element 10 between two bending states with a first and second curvatures. The clamping elements of the epilating element function in accordance with the bending action of the epilating element.

A disadvantage of the known depilating devices is that the design of the depilating body is a compromise resulting from a need to adapt the design to enable the depilating body to effectively catch hairs on the one hand and a need to adapt the design to enable the depilating body to exert sufficient force on the hairs for clamping the hairs. It is an object of the invention to provide a new type of depilating device in which both functions of catching hairs and clamping hairs with sufficient force can be optimized.

SUMMARY OF THE INVENTION

The invention provides a depilating device comprising a depilating body which is rotatable about a rotation axis extending in a longitudinal direction with respect to the depilating body and which is provided with at least one hair-catching space, wherein the size of the at least one hair-catching space in the longitudinal direction is variable through compression and extension of the depilating body in the longitudinal direction, and an actuating mechanism configured to act on the depilating body so as to cause compression and extension of the depilating body in the longitudinal direction during rotational movement of the depilating body about the rotation axis, wherein the actuating mechanism includes a force-inducing member configured which is compressible and extensible in the longitudinal direction and which is configured to determine the level of a force exerted by the actuating mechanism on the depilating body in the longitudinal direction when the size of the force-inducing member in the longitudinal direction is varied while the at least one hair-catching space of the depilating body is in a closed condition.

It follows from the foregoing definition that the actuating mechanism of the depilating device according to the invention includes a force-inducing member which, like the depilating body, is compressible and extensible in the longitudinal direction. As a result of the presence of the force-inducing member in the actuating mechanism, the hair-clamping force is no longer determined by a force-displacement characteristic of compression and extension of the depilating body only, but also by a force-displacement characteristic of compression and extension of the force-inducing member. This means that a configuration is obtained in which the design of the depilating body can be adapted so as to have optimal hair-catching functionality of the depilating body and in which the design of the force-inducing member can be adapted so as to have optimal hair-clamping functionality of the depilating body as well.

The invention offers the possibility of letting the hair-clamping force in the depilating body mainly be determined by the force-inducing member of the actuating mechanism, so that the hair-clamping force is practically not influenced by the amount of hairs caught in the depilating body. In the conventional case of the hair-clamping force being determined by the constitution of the depilating body itself, the hair-clamping force increases with the number of hairs in the depilating body. This effect can be counteracted when the invention is put to practice, as there is no longer a need for the hair-clamping force to be directly determined at the position where the hairs are present in the depilating body. Instead, it is possible to use the force-inducing member for determining the level of a force exerted by the actuating mechanism on the depilating body in the longitudinal direction when the size of the force-inducing member in the longitudinal direction is varied while the at least one hair-catching space of the depilating body is in a closed condition, which force yields the hair-clamping force under the conditions as mentioned. Further, when the force-inducing member of the actuating mechanism is relied on for setting the level of the hair-clamping force in the depilating body, indeed, variations in dimensions of the depilating body due to tolerances are compensated for, so that a predetermined level of the hair-clamping force may always be realized in practice. Thus, on the basis of the invention, consistency of performance is increased when depilating devices are manufactured in mass amounts.

It is noted that in the context of the present description, a force-displacement characteristic of compression and extension is to be understood as a characteristic of a body indicating a relation between a level of force generated in the body and a level of displacement of the body in the form of extension or compression of the body or, stated the other way around, as a characteristic of a body indicating a level of force to be exerted on the body for producing a certain displacement of the body in the form of extension or compression of the body. The force-displacement characteristic of compression and extension of a body is also referred to as the stiffness of the body in case the body is of the type having resilient/elastic/flexible properties.

An advantageous effect of the hair-clamping force mainly being determined by the force-displacement characteristic of compression and extension of the force-inducing member instead of the force-displacement characteristic of compression and extension of the depilating body is especially obtained if the force-displacement characteristic of compression and extension of the force-inducing member is significantly stronger than a force-displacement characteristic of compression and extension of the depilating body. The fact is that in such a case, when the actuating mechanism acts to compress the depilating body, this is done with practically no force until the at least one hair-catching space of the depilating body is closed. From that moment on, the level of forces acting at the position of the depilating body in the longitudinal direction is determined by the force-inducing member on the basis of the force-displacement characteristic of compression and extension thereof, wherein the influence of the force-displacement characteristic of compression and extension of the depilating body on the level of the forces is only minimal. It is noted that by a stronger force-displacement characteristic is meant a force-displacement characteristic relating higher force to the same displacement.

Another notable advantage of the application of a force-inducing member in the actuating mechanism of the depilating device is that this involves a possibility of adapting the operation of the depilating device to actual circumstances. For example, in a case of grease being present on skin, it is desirable to increase the hair-clamping force in order to compensate for the reduced friction force involved in such a case. In the framework of the invention, this can be done if the force-inducing member is of a type having an adjustable force-displacement characteristic of compression and extension in the longitudinal direction. Thus, it is very practical to equip the actuating mechanism with such a type of force-inducing member. With reference to the example of needing to increase the hair-clamping force, this involves adjustment of the force-displacement characteristic of compression and extension in such a way that a certain displacement involves a higher level of force.

The force-inducing member may be of any suitable type. In this first place, it is noted that the force-inducing member may be a passive force-inducing member, and may be of a type which is commonly denoted as resilient, elastic and/or flexible, wherein the force-inducing member may comprise a piece of resilient/elastic material such as rubber, or a spring, for example. In respect of the option of the force-inducing member comprising a spring, the spring may be of any suitable type, such as a coil spring which is normally closed or normally opened, and the option of adjusting the force-displacement characteristic of compression and extension of the force-inducing member may involve the depilating device comprising an adjusting mechanism configured to adjust the spring constant of the spring. According to a further advantageous option, the depilating device may comprise an adjusting mechanism configured to adjust pretension of the spring. In the second place, the force-inducing member may be an active force-inducing member designed to perform the force-inducing function in an activated, energized condition, and may comprise a solenoid, for example.

The arrangement of the depilating body in the depilating device may be such that one end of the depilating body is a fixed end having a fixed position in the longitudinal direction and the other end of the depilating body is a movable end having a variable position in the longitudinal direction, wherein the actuating mechanism is configured to act on the depilating body at the side of the movable end thereof. When the at least one hair-catching space of the depilating body is closed and the actuating mechanism acts to subject the depilating body to forces in a direction associated with compressing the depilating body, the depilating body is fixed in place and the hair-clamping force is effectively built up. Further, having a fixed part of the depilating body facilitates positioning the depilating body relative to skin to be subjected to a depilating action.

In a practical embodiment, the depilating device according to the invention further comprises a driving mechanism configured to drive the depilating body so as to perform a rotational movement about the rotation axis. A compact design of the depilating device may be realized if the driving mechanism is configured to also drive the actuating mechanism so as to cause compression and extension of the depilating body in the longitudinal direction. Further, in such a case, it is possible to have such a drive configuration that the function of causing compression and extension of the depilating body in the longitudinal direction is linked to the function of rotating the depilating body, so that a predetermined relation between the two functions can be realized in a mechanical fashion, particularly a relation of a number of times compressing and stretching the depilating body per revolution of the depilating body. In the framework of the invention, measures may be taken to allow adjustment of the relation between the two functions according to desire.

In a practical embodiment of the depilating device according to the invention, the actuating mechanism comprises two actuating members which are both movable in the longitudinal direction, a first one of the actuating members being at a position closer to the depilating body in the longitudinal direction than a second one of the actuating members, wherein the force-inducing member is at a position of coupling the actuating members to each other. In such a configuration, the first one of the actuating members may be arranged to directly contact the depilating body. Also, the actuating members are preferably rigid in comparison to the force-inducing member, in which case the force-displacement characteristic of compression and extension of the combination of the actuating members and the force-inducing member is determined by the force-displacement characteristic of compression and extension of the force-inducing member. Further, when the actuating mechanism comprises two actuating members as mentioned, it may be practical if the driving mechanism comprises a rotatable drive shaft coupled to the depilating body for imposing rotational movement on the depilating body, and if each of the actuating members is bush-shaped and at a position for surrounding a portion of the drive shaft. Inducing the two different movements of the depilating body, i.e. the rotational movement and the longitudinal compressing/extending movement, by means of separate components contributes to the overall accuracy of the depilating device.

As mentioned earlier, it is possible to realize a link between the function of causing compression and extension of the depilating body in the longitudinal direction and the function of rotating the depilating body in a mechanical way. For example, in the case of the driving mechanism comprising a rotatable drive shaft coupled to the depilating body and each of the actuating members being bush-shaped and at a position for surrounding a portion of the drive shaft, it may be beneficial if the depilating device comprises a movement-imposing arrangement including a cam and cam follower, wherein one of the cam and cam follower has a fixed position in the depilating device, and wherein the other one of the cam and cam follower is attached to the second one of the actuating members. In such a configuration, movement of at least the second actuating member in the longitudinal direction is automatically induced as the drive shaft rotates, in a predetermined way following from the design of the cam and cam follower. The design of the moving-imposing arrangement may be chosen such as to realize a speed of closing the at least one hair-catching space of the depilating body which is high enough for achieving good hair-catching results and consequently achieving good depilation results, and which is low enough to not incur high (peak) forces in the depilating device.

In the framework of the invention, it is possible for the link between the function of causing compression and extension of the depilating body in the longitudinal direction and the function of rotating the depilating body to be tunable. In that case, the movement-imposing arrangement may include a suitable actuator and a mechanism allowing a user of the depilating device to adjust the moments of opening and closing the at least one hair-catching space of the depilating body during the rotations of the depilating body.

The depilating body may be of any suitable design. Practical examples are a linear coil spring and a linear arrangement of discs. The size of the depilating body in the longitudinal direction can be chosen freely, and the same is applicable to the number of hair-catching spaces. In the exemplary case of a coil spring, the number of windings may be chosen so as to be only two or an appropriate higher number, whatever the case may be. A small number of windings may be practical if the depilating device is intended to be used as a facial depilating device, as especially in such a case, it may be desired to prevent blockage of vision by the depilating body as much as possible and it may be appropriate for the depilating device to be capable of depilating only one hair or not many more hairs at a time. Further, in the exemplary case of a coil spring, it is possible to have a conventional circular cross-section of the spring's wire, but it is also possible to have another cross-section such as a square or rectangular cross-section in order to increase the range of hair lengths of hairs to be caught by the depilating body. As mentioned earlier, the invention covers both the option of a coil spring being normally opened, in which case the actuating mechanism acts to actively compress the coil spring, and the option of a coil spring being normally closed, in which case the actuating mechanism acts to actively stretch the coil spring.

The above-described and other aspects of the invention will be apparent from and elucidated with reference to the following detailed description of an embodiment of a depilating device comprising an actuating mechanism which includes a force-inducing member which is compressible and extensible in a longitudinal direction, i.e. a force-inducing member of variable size in the longitudinal direction.

BRIEF DESCRIPTION OF THE DRAWINGS

The invention will now be explained in greater detail with reference to FIG. 1, which is a diagrammatic sectional view of an assembly of components of a depilating device according to an embodiment of the invention.

DETAILED DESCRIPTION OF THE EMBODIMENTS

FIG. 1 illustrates the design of an depilating device 1 according to an embodiment of the invention. The particular depilating device 1 represented in FIG. 1 and described in the following is just one example of many types of depilating devices which are feasible in the framework of the invention. It is practical for the depilating device 1 to be a handheld device including a housing 2 for accommodating a number of components of the device. The housing 2 is diagrammatically depicted as a dashed rectangle in FIG. 1. The depilating device 1 may be intended for use as a facial depilating device 1, for example.

The depilating device 1 is configured to be used for the purpose of performing a hair removing operation on skin. In view thereof, the depilating device 1 comprises a depilating body 10 which is intended to actually interact with the hairs to be plucked from the skin. For the purpose of catching and clamping the hairs, the depilating body 10 is provided with at least one hair-catching space 11. The depilating body 10 is designed so as to be compressible and extensible in a longitudinal direction L, and may comprise a coil spring, for example. The longitudinal direction L is indicated by means of a double-headed arrow in FIG. 1. Further, the depilating body 10 is rotatable in the depilating device 1 about a rotation axis R extending in the longitudinal direction L.

Besides the depilating body 10, the depilating device 1 comprises a driving mechanism 20 which is configured to drive the depilating body so as to actually perform a rotational movement about the rotation axis R during operation of the depilating device 1. In the shown example, the driving mechanism 20 comprises a drive shaft 21 which is also rotatable about the rotation axis R and an electric motor 22 for driving the drive shaft 21, wherein the depilating body 10 is arranged on the drive shaft 21 at the position of an end portion of the drive shaft 21 so that when the drive shaft 21 is driven by the electric motor 22, the depilating body 20 rotates along with the drive shaft 21.

Further, the depilating device 1 comprises an actuating mechanism 30 which is configured to act on the depilating body 10 so as to vary the size of the depilating body 10 in the longitudinal direction L during rotational movement of the depilating body 10 about the rotation axis R. In the shown example, one end of the depilating body 10 is fixedly connected to the drive shaft 21 and has a fixed position in the longitudinal direction L as a result thereof. In this configuration, the actuating mechanism 30 is arranged so as to interact with the other end of the depilating body 10 for the purpose of displacing the other end of the depilating body 10 with respect to the drive shaft 21 in the longitudinal direction L. In the following, the first-mentioned end of the depilating body 10 will be referred to as fixed end of the depilating body 10, and the other end of the depilating body 10 will be referred to as movable end of the depilating body 10.

The actuating mechanism 30 comprises a first actuating member 31 which is shaped like a bush extending in the longitudinal direction L, and which is arranged to surround a portion of the drive shaft 21 adjacent to the end portion supporting the depilating body 10, wherein the first actuating member 31 is slidable on the drive shaft 21 in the longitudinal direction L and is positioned so as to contact the movable end of the depilating body 10. Further, the actuating mechanism 30 comprises a second actuating member 32 which is shaped like a bush extending in the longitudinal direction L, and which is arranged to surround a portion of the drive shaft 21 which is further away from the depilating body 10 in the longitudinal direction L than the portion of the drive shaft 21 surrounded by the first actuating member 31, wherein the second actuating member 32 is also slidable arranged on the drive shaft 21 in the longitudinal direction L. Still further, the actuating mechanism 30 comprises a force-inducing member 33 which is at a position of coupling the actuating members 31, 32 to each other, i.e. a position between the actuating members 31, 32 in the longitudinal direction L. In the shown example, the force-inducing member 33 comprises a coil spring which is arranged so as to surround the drive shaft 21, which coil spring may be a normally-closed coil spring or a normally-opened coil spring. The force-inducing member 33 is covered by a cylindrical cover 34 surrounding the force-inducing member 33 and overlapping with end portions of the actuating members 31, 32 as well, wherein the cylindrical cover 34 is connected to the second actuating member 32.

The present description is equally applicable when the force-inducing member 33 does not comprise a coil spring but another component or combination of components which is designed so as to be compressible and extensible in the longitudinal direction L. The actuating members 31, 32 and the force-inducing member 33 may be provided as three separate components joined together, which does not alter the fact that other options are possible as well, such as an option of the actuating members 31, 32 and the force-inducing member 33 being part of a single integral entirety having different zones, wherein an intermediate zone may have another force-displacement characteristic of compression and extension than the two other zones at the respective sides of the intermediate zone.

At the position of the other end of the second actuating member 32 than the end which is associated with the force-inducing member 33, a movement-imposing arrangement 40 including a cam 41 and cam follower 42 is present in the depilating device 1. The movement-imposing arrangement 40 is configured to impose movement in the longitudinal direction L on the second actuating member 32 when the drive shaft 21 rotates. To that end, one of the cam 41 and cam follower 42 has a fixed position in the depilating device 1, and the other one of the cam 41 and cam follower 42 is attached to the second actuating member 32. In the shown example, the cam follower 42 has the fixed position in the depilating device 1, and the cam 41 is attached to the second actuating member 32. FIG. 1 also illustrates an application of stops 23, 24 on the drive shaft 21 for delimiting the positions of the first actuating member 31 and the second actuating member 32, respectively, in the longitudinal direction L.

The length of the depilating body 10 may be chosen freely in the framework of the invention, depending on intended use of the depilating device 1. When the depilating body 10 comprises a coil spring, the number of windings of the coil spring can be chosen freely, and also the shape of the cross-section of the spring's wire can be chosen freely. Further, the material of the depilating body 10 can be treated material (material subjected to treatment such as mechanical treatment, chemical treatment or heat treatment) so as to have defined/improved grip of the depilating body 10 on the hairs. The depilating body 10 can be rotational symmetrical so that the depilating device 1 is effective in any position relative to skin to be subjected to a depilating action. The drive shaft 21 may be connected directly to the electric motor 22, or through a suitable gearbox system, for example.

With reference to the above explanation of design aspects of the depilating device 1 according to an embodiment of the invention, it is now described how the various components of the depilating device 1 function to enable the depilating device 1 to perform a depilating action during operation thereof. Operation of the depilating device 1 involves actuation of the electric motor 22, as a result of which the drive shaft 21 is driven so as to rotate about the rotation axis R. The rotational movement of the drive shaft 21 causes both a rotational movement of the depilating body 10 about the rotation axis R and cyclic variation of the size of the depilating body 10 in the longitudinal direction L. The rotational movement of the depilating body 10 about the rotation axis R follows directly from the arrangement of the depilating body 10 on the drive shaft 21. The process of alternately causing compression and extension of the depilating body 10 in the longitudinal direction L follows from the movement-imposing arrangement 40 dictating the position of the second actuation member 32 in the longitudinal direction L. The fact is that as the drive shaft 21 rotates about the rotation axis R, the position of the cam 41 of the movement-imposing arrangement 40 in the longitudinal direction L is varied under the influence of contact to the cam follower 42, and so is the position of the second actuating member 32 in the longitudinal direction L.

As long as the at least one hair-catching space 11 of the depilating body 10 is not in the closed condition, the variation of the position of the second actuating member 32 brings about a similar variation of the position of the first actuating member 31, through the force-inducing member 33. On the basis of the fact that the first actuating member 31 acts on the depilating body 10, rotation of the drive shaft 21 about the rotation axis R eventually brings about variation of the position of the movable end of the depilating body 10 in the longitudinal direction L, besides the rotation of the depilating body 10 about the rotation axis R. The displacement path followed by the movable end of the depilating body 10 in the process is determined by the design of the movement-imposing arrangement 40, and so is the relation between the number of times the depilating body 10 is compressed and stretched per revolution. When the at least one hair-catching space 11 of the depilating body 10 is closed, variation of the position of the movable end of the depilating body 10 and the position of the first actuating member 31 is no longer allowed, and the second actuating member 32 performs a movement in the longitudinal direction L relative to the first actuating member 31, which relative movement is allowed due to the presence of the force-inducing member 33 in the actuating mechanism 30. In the process, a force exerted on the depilating body 10 in the longitudinal direction L by the actuating mechanism 30 is determined by the constitution of the force-inducing member 33, particularly the force-displacement characteristic of compression and extension of the force-inducing member 33, and it is this force that determines a hair-clamping force at the position of the hair-catching space 11.

As a result of the cycle of compressing and stretching the depilating body 10 in the longitudinal direction L, the size of the at least one hair-catching space 11 in the depilating body 10 is alternately reduced and increased in the longitudinal direction L, such that the hair-catching space 11 is alternately put to the above-mentioned closed condition and an opened condition. When the depilating body 10 is held at a position close to skin from which hairs protrude, hairs are caught in the hair-catching space 11 during a period that the condition of the hair-catching space 11 changes from the opened condition to the closed position. When the hair-catching space 11 is in the closed position, the hairs are fixed in place in the hair-catching space 11 under the influence of a clamping force acting on the hairs in the longitudinal direction L. Assuming that the hair-clamping force is higher than the holding force exerted on the hairs at the position of the skin, the hairs are pulled out of the skin as a result of the rotational movement of the depilating body 10. On the basis of the presence of the force-inducing member 33 in the actuating mechanism 30 of the depilating device 1, the invention allows for having an accurately defined hair-clamping force under all circumstances, and also for compensating for manufacturing tolerances of the depilating body 10, while the design of the depilating body 10 can be chosen so as to achieve optimal hair catching.

The aspect of compensating for manufacturing tolerances of the depilating body 10 is advantageous because if the force-inducing member 33 would not be present in the depilating device 1, it might occur that the movement-imposing arrangement 40 still acts to put the at least one hair-catching space 11 to the closed position while the hair-catching space 11 has already reached the closed position, in which case forces acting in the depilating device 1 increase to unforeseen high levels, or it might occur that the movement-imposing arrangement 40 is already at a maximum position for compressing the depilating body 10 while the hair-catching space 11 is still not fully closed, in which case the depilating body 10 cannot be effective in performing its depilating function.

The aspect of allowing for having an accurately defined hair-clamping force under all circumstances is particularly obtained when the force-displacement characteristic of compression and extension of the force-inducing member 33 is significantly stronger than the force-displacement characteristic of compression and extension of the depilating body 10. In fact, in the shown example, it is sufficient if the force-displacement characteristic of compression and extension of the depilating body 10 is such that the depilating body 10 is capable of pushing back the components of the actuating mechanism 30 when the movement-imposing arrangement 40 offers space for doing so.

An advantageous option existing in the framework of the invention is an option of tuning the force-inducing member 33, i.e. adjusting the force-displacement characteristic of compression and extension of the force-inducing member 33, as such option allows for having different modes of the depilating device 1, wherein an appropriate one of the modes may be set in dependency on environmental conditions such as soiling of the skin with grease. Also, the invention offers a possibility of setting pre-tension of the force-inducing member 33 to an appropriate value.

It will be clear to a person skilled in the art that the scope of the invention is not limited to the examples discussed in the foregoing, but that several amendments and modifications thereof are possible without deviating from the scope of the invention as defined in the attached claims. It is intended that the invention be construed as including all such amendments and modifications insofar they come within the scope of the claims or the equivalents thereof. While the invention has been illustrated and described in detail in the figures and the description, such illustration and description are to be considered illustrative or exemplary only, and not restrictive. The invention is not limited to the disclosed embodiments. The drawings are schematic, wherein details which are not required for understanding the invention may have been omitted, and not necessarily to scale.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. Any reference signs in the claims should not be construed as limiting the scope of the invention.

Elements and aspects discussed for or in relation with a particular embodiment may be suitably combined with elements and aspects of other embodiments, unless explicitly stated otherwise. Thus, the mere fact that certain measures are recited in mutually different dependent claims does not indicate that a combination of these measures cannot be used to advantage.

The terms "comprise" and "include" as used in this text will be understood by a person skilled in the art as covering the term "consist of". Hence, the term "comprise" or "include" may in respect of an embodiment mean "consist of", but may in another embodiment mean "contain/have/be equipped with at least the defined species and optionally one or more other species".

Notable aspects of the invention are summarized as follows. A depilating device 1 comprises a depilating body 10 which is rotatable about a rotation axis R extending in a longitudinal direction L with respect to the depilating body 10 and which is provided with at least one hair-catching space 11. The depilating device 1 further comprises an actuating mechanism 30 configured to act on the depilating body 10 so as to cause compression and extension of the depilating body 10 in the longitudinal direction L during rotational movement of the depilating body 10 about the rotation axis R, for the purpose of varying the size of the at least one hair-catching space 11 of the depilating body 10 in the longitudinal direction L, wherein the actuating mechanism 30 includes a force-inducing member 31 which is compressible and extensible in the longitudinal direction L and which has a function in determining the level of a hair-clamping force in the depilating body 10.

The invention claimed is:

1. A depilating device, comprising:

a depilating body which is rotatable about a rotation axis extending in a longitudinal direction with respect to the depilating body and which is provided with at least one hair-catching space, wherein a size of the at least one hair-catching space in the longitudinal direction is variable through compression and extension of the depilating body in the longitudinal direction; and an actuating mechanism configured to act on the depilating body so as to cause compression and extension of the depilating body in the longitudinal direction during rotational movement of the depilating body about the rotation axis, wherein the actuating mechanism includes a force-inducing member which is compressible and extensible in the longitudinal direction and which is configured to determine a level of a force exerted by the actuating mechanism on the depilating body in the longitudinal direction when a size of the force-inducing member in the longitudinal direction is varied while the at least one hair-catching space of the depilating body is in a closed condition, wherein a force-displacement characteristic of compression and extension of the force-inducing member in the longitudinal direction is stronger than a force-displacement characteristic of compression and extension of the depilating body in the longitudinal direction.

2. The depilating device according to claim 1, wherein the force-inducing member is a passive force-inducing member.

3. The depilating device according to claim 2, wherein the force-inducing member comprises a spring.

4. The depilating device according to claim 1, wherein the force-inducing member is an active force-inducing member designed to perform a force-inducing function in an activated, energized condition.

5. The depilating device according to claim 4, wherein the force-inducing member comprises a solenoid.

6. The depilating device according to claim 1, wherein one end of the depilating body is a fixed end having a fixed position in the longitudinal direction and an opposite end of the depilating body is a movable end having a variable position in the longitudinal direction, and wherein the actuating mechanism is configured to act on the depilating body at a side of the movable end thereof.

7. The depilating device according to claim 1, further comprising a driving mechanism configured to drive the depilating body so as to perform a rotational movement about the rotation axis.

8. The depilating device according to claim 7, wherein the driving mechanism is configured to also drive the actuating mechanism so as to cause compression and extension the depilating body in the longitudinal direction.

9. The depilating device according to claim 7, wherein the actuating mechanism comprises two actuating members which are both movable in the longitudinal direction, a first one of the two actuating members being at a position closer to the depilating body in the longitudinal direction than a second one of the two actuating members, and wherein the force-inducing member is at a position of coupling the two actuating members to each other.

10. The depilating device according to claim 9, wherein the driving mechanism comprises a rotatable drive shaft coupled to the depilating body for imposing rotational movement on the depilating body, and wherein each of the two actuating members is bush-shaped and at a position for surrounding a portion of the drive shaft.

11. The depilating device according to claim 10, comprising a movement-imposing arrangement including a cam and a cam follower, wherein one of the cam and the cam follower has a fixed position in the depilating device, and wherein the other one of the cam and the cam follower is fixed to the second one of the two actuating members.

12. The depilating device according to claim 1, wherein the depilating body comprises a linear coil spring.

13. A depilating device, comprising:

a depilating body rotatable about a rotation axis extending in a longitudinal direction with respect to the depilating body, the depilating body comprising at least one hair-catching space, wherein a size of the at least one hair-catching space in the longitudinal direction is variable through compression and extension of the depilating body in the longitudinal direction;

a rotatable drive shaft coupled to the depilating body and a motor for imposing rotational movement on the depilating body about the rotation axis;

a first actuator movable in the longitudinal direction and arranged to surround a first portion of the drive shaft adjacent to an end portion supporting the depilating body;

a second actuator movable in the longitudinal direction and arranged to surround a second portion of the drive shaft further away from the depilating body in the longitudinal direction than the first portion of the drive shaft, wherein the first and second actuators are configured to act on the depilating body to cause compression and extension of the depilating body in the longitudinal direction during the rotational movement of the depilating body about the rotation axis; and a coil spring configured to couple the first and second actuators to each other, wherein the coil spring is compressible and extensible in the longitudinal direction and is configured to determine a level of a force exerted by the first actuator on the depilating body in the longitudinal direction when a size of the coil spring in the longitudinal direction is varied while the at least one hair-catching space of the depilating body is in a closed condition, wherein a force-displacement characteristic of compression and extension of the coil spring in the longitudinal direction is stronger than a force-displacement characteristic of compression and extension of the depilating body in the longitudinal direction.

* * * * *